US006578711B1

(12) United States Patent
Chou

(10) Patent No.: US 6,578,711 B1
(45) Date of Patent: Jun. 17, 2003

(54) PACKING BOX FOR A LASHING ROPE WINCH

(76) Inventor: An-Chuan Chou, No. 212, Yung An Street, Tainan (TW)

( * ) Notice: Subject to any disclaimer, the term of this patent is extended or adjusted under 35 U.S.C. 154(b) by 0 days.

(21) Appl. No.: 10/241,771

(22) Filed: Sep. 12, 2002

(51) Int. Cl.[7] ..... B65D 73/00

(52) U.S. Cl. ..... 206/467; 206/340; 206/471; 206/806

(58) Field of Search ..... 206/340, 372, 206/373, 376, 461, 464, 467, 470, 471, 806

(56) References Cited

U.S. PATENT DOCUMENTS 4,378,068 A * 3/1983 Bell ..... 206/806
4,805,766 A * 2/1989 Garcia ..... 206/471
5,988,382 A * 11/1999 Ritchie et al. ..... 206/372
6,378,700 B1 * 4/2002 Tong ..... 206/376
6,401,923 B1 * 6/2002 Huang ..... 206/376

* cited by examiner

*Primary Examiner*—Luan K. Bui
(74) *Attorney, Agent, or Firm*—Rosenberg, Klein & Lee

(57) ABSTRACT

A packing box for a lashing rope winch includes a holding plate, an upper cover, and a lower cover. The holding plate has several containing recesses arranged side by side. The holding plate has several pairs of opposite securing protrusions for allowing tight insertion of a main body of a winch into between when the winch is held in one containing recess. The upper cover is pivoted to the lateral edges of the holding plate to cover an upper section of the containing recesses, while the lower cover is detachably joined to the lower portion of the holding plate. Thus, the winch can be easily taken out from the packing box to be tried and inspected by consumers.

6 Claims, 6 Drawing Sheets

PACKING BOX FOR A LASHING ROPE WINCH

BACKGROUND OF THE INVENTION

The present invention relates to a packing box, more particularly a packing box, which is provided for containing a lashing rope winch therein, and which allows the winch to be easily taken out from it for trial by consumers without causing damage to any part thereof Manufacturers usually accommodate lashing rope winches in packing boxes so that they are well protected from getting damaged. The packing boxes allow the products to be easily displayed. Referring to FIG. 1, a conventional packing box consists of a cardboard 10, and a transparent front holding member 30. The transparent holding member 30 is shaped to have a holding room for the product. The cardboard 10, and the transparent holding member 30 are firmly joined together by means of driving staples through the edges of both so that the product is well protected.

However, this conventional packing box has disadvantages as followings:

1. Staples used for such boxes are usually relatively big in size, and cannot be easily removed therefore it is not convenient for customers to take out the winch product from the packing box for trial or inspection.
2. It not feasible for the customers to take out the winch product for trial and inspection, and the customers only can try to know about the product from the appearance and brief written description. Consequently, the customers cannot easily make up their minds to buy. And, the product is more likely to turn out to be unsuitable after the customers buy it.

SUMMARY OF THE INVENTION

Therefore, it is a main object of the present invention to a packing box for a lashing rope winch, which allows the winch to be easily taken out from it for trial and inspection by consumers without possibility of damage being caused to any part thereof.

The present packing box for a lashing rope winch includes a holding plate, an upper cover, and a lower cover. The holding plate has several containing recesses arranged side by side. The holding plate has several pairs of opposite securing protrusions for allowing tight insertion of a main body of a winch into between when the winch is held in one containing recess. The upper cover is pivoted to upper ends of the lateral edges of the holding plate, while the lower cover is detachably joined to the lower portion of the holding plate.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
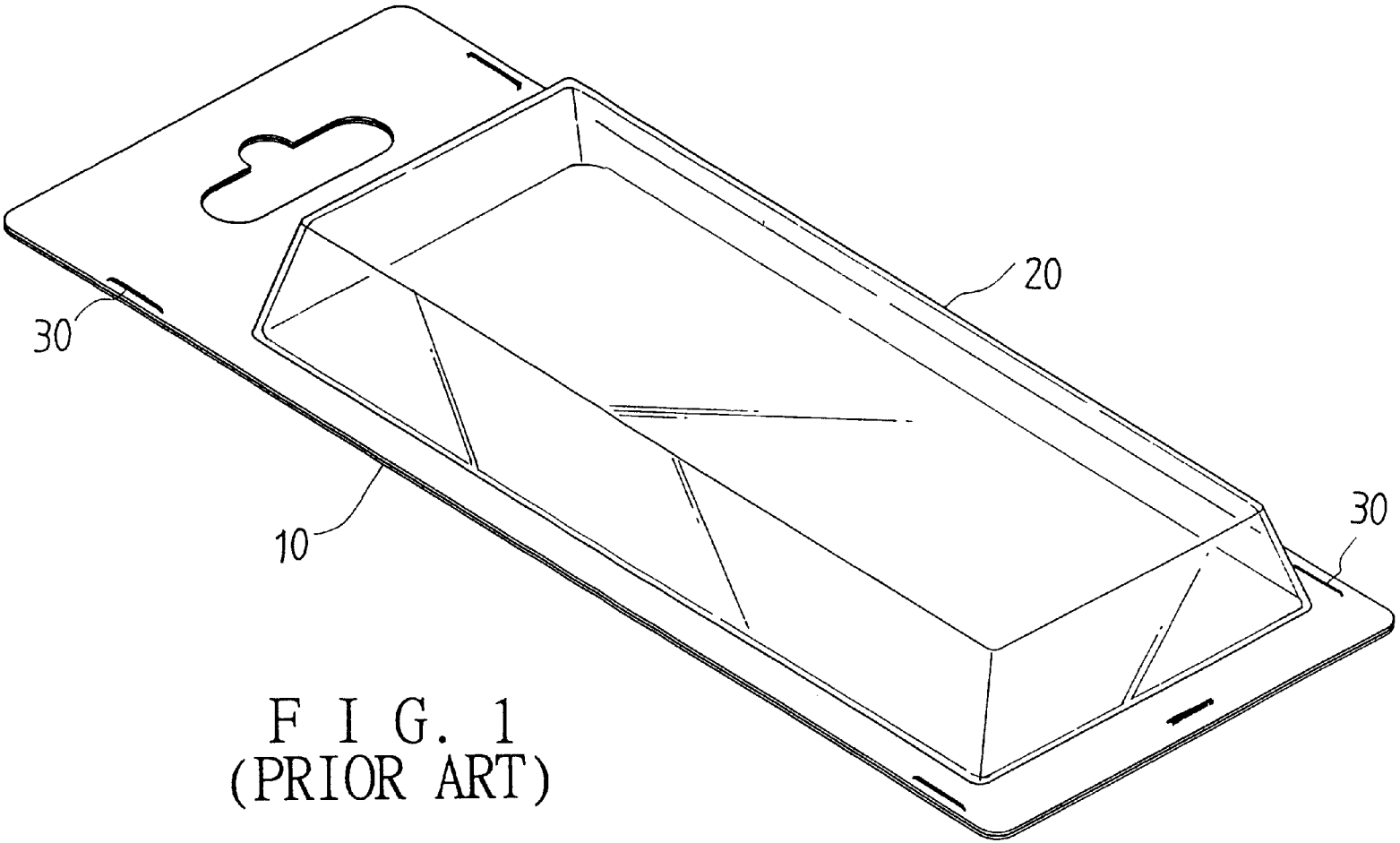
FIG. 1 (PRIOR ART)
FIG. 1 is a perspective view of the conventional packing box as described in the Background.
Figure 2:
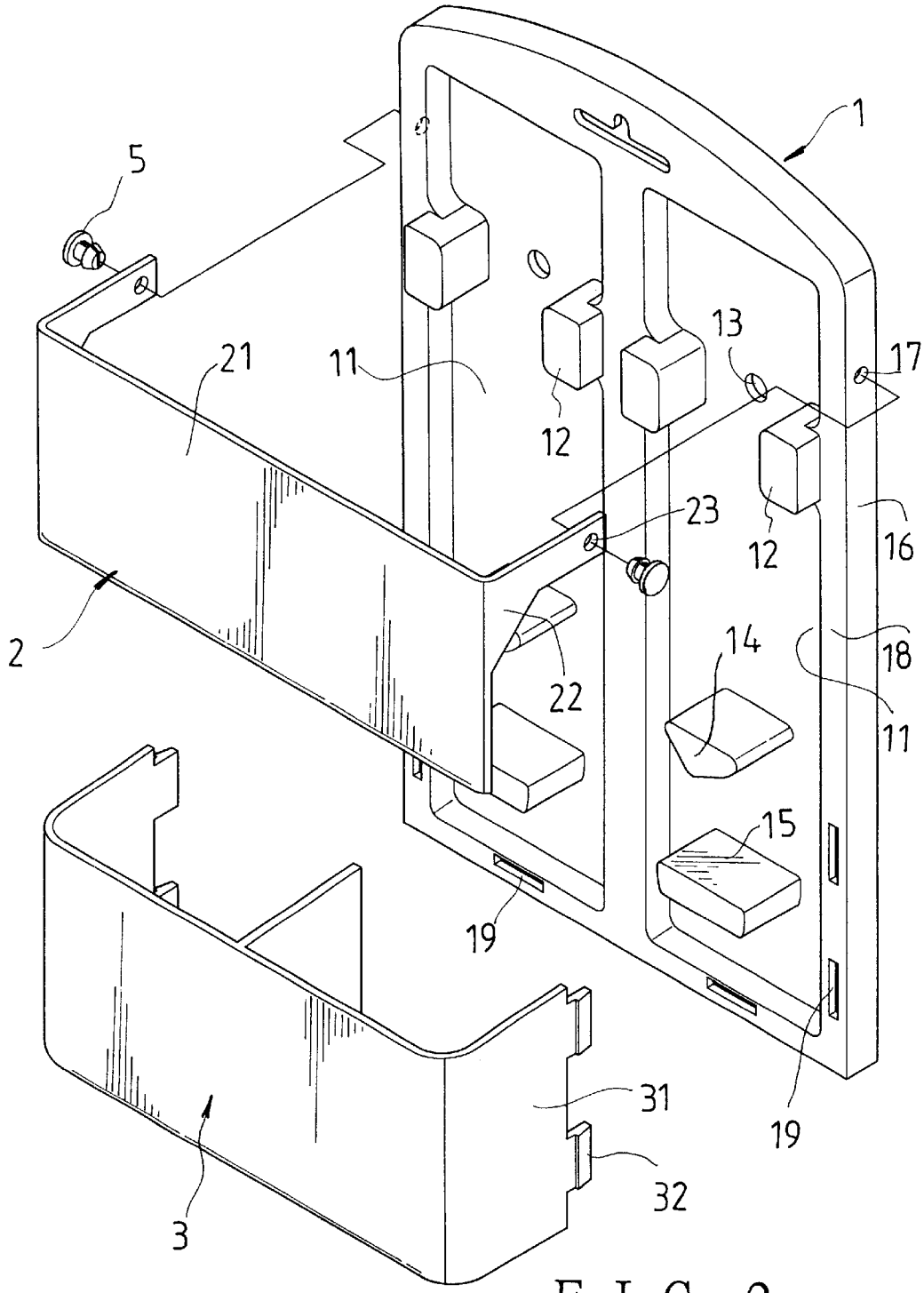
FIG. 2 is an exploded perspective view of the packing box of a first embodiment of the present invention.

Referring to FIG. 2, a packing box for a lashing rope winch according to present invention includes a holding plate 1, an upper cover 2, and a lower cover 3.

The holding plate 1 has walls 18 sticking out from edges and intermediate portions of a front side thereof to define several containing rooms 11. The walls 18 are formed in such a manner that the containing rooms 11 are arranged side by side. The holding plate 1 has pivotal holes 17 on lateral surfaces 16 of tipper portions of the outermost lateral ones of the walls 18, and connecting holes 19 on front sides of lower portions of the outermost lateral walls 18. Furthermore, the holding plate 1 is formed with a through hole 13 in an upper portion of each of the containing rooms 11.

Each of the containing rooms 11 has two opposite securing protrusions 12 formed adjacent to upper portions of two lateral opposing ones of the walls 18 thereof so that a main body of a lashing rope winch can be tightly inserted into between. Furthermore, the holding plate 1 has a pair of spaced apart upper and lower securing poles 14, and 15 in a lower portion of each of the containing rooms 11.

The upper cover 2 has a main covering portion 21, and two opposite lateral portions 22 sticking out from edges of the main portion 21. Each of the lateral portions 22 has a through hole 23.

The lower cover 3 has a main covering portion (not numbered), and two opposite lateral portions 31 sticking out from edges of the main portion. Each of the lateral portions 31 has several engaging hooks 32 on the rear ends.

In combination, the upper cover 2 is pivoted to the to the outermost lateral walls 18 of the holding plate 1 by means of passing pivotal pins through the through holes 23 and the pivotal holes 17 so that it can movably cover an upper section of the containing rooms 11. And, the lower cover 3 is detachably joined to the lower portions of the outermost lateral walls 18 with the engaging hooks 32 being inserted into the connecting holes 19 of the front sides of the walls 18.

Figure 3:
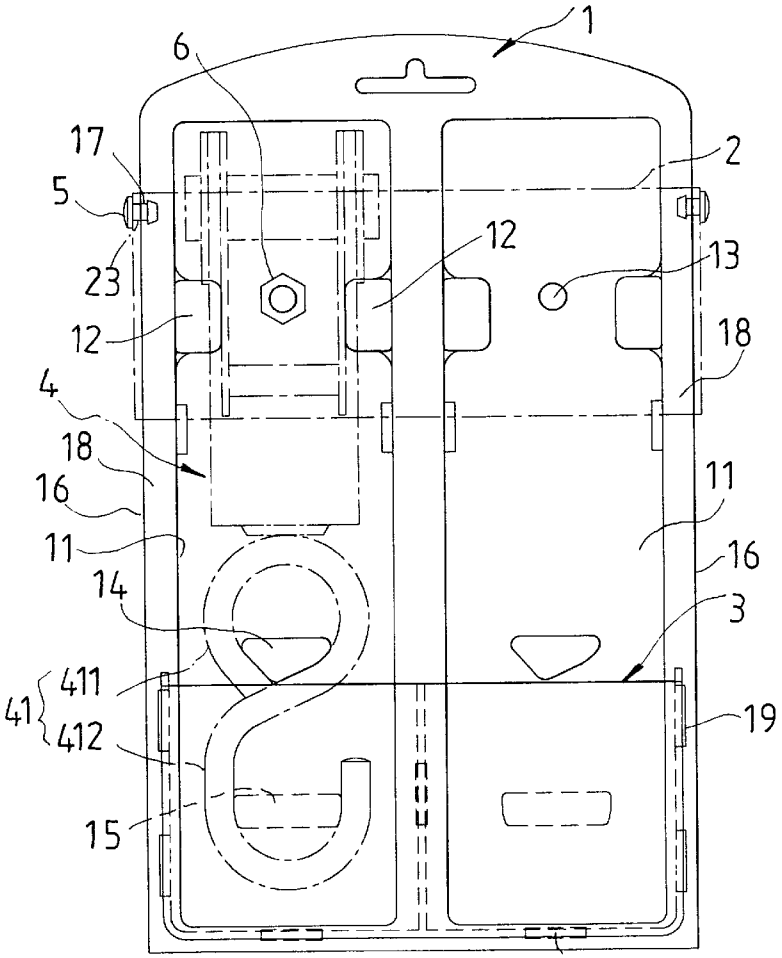
FIG. 3 is a front view of the packing box of the first embodiment of the present invention.
Figure 4:
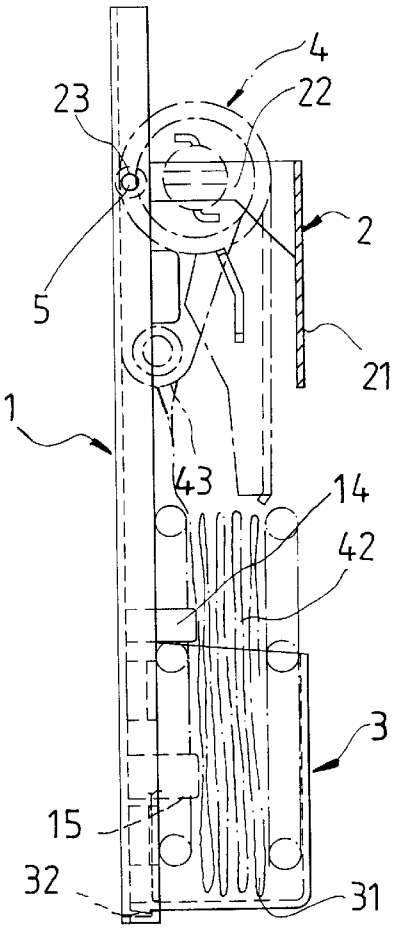
FIG. 4 is a side view of the packing box of the first embodiment of the present invention.

Referring to FIG. 3, to hold a lashing rope winch 4 in the packing box, a main body 43 of the winch 4 is tightly inserted between the securing protrusions 12 of one containing room 11 after ropes 42 of the winch 4 have been folded, and a circular portion 411 and a hooked portion 412 of a hook 41 of the lashing rope winch are respectively mounted around the spaced apart upper and lower securing poles 14, and 15 of the holding plate 1. And, a screw 6 is screwed into both the through hole 13 of the plate 1 and a hole on the main body 43 of the winch 4 to fix the winch 4 in position. In addition, tags and written description of the winch are fastened to the covers 2 and 3.

Figure 5:
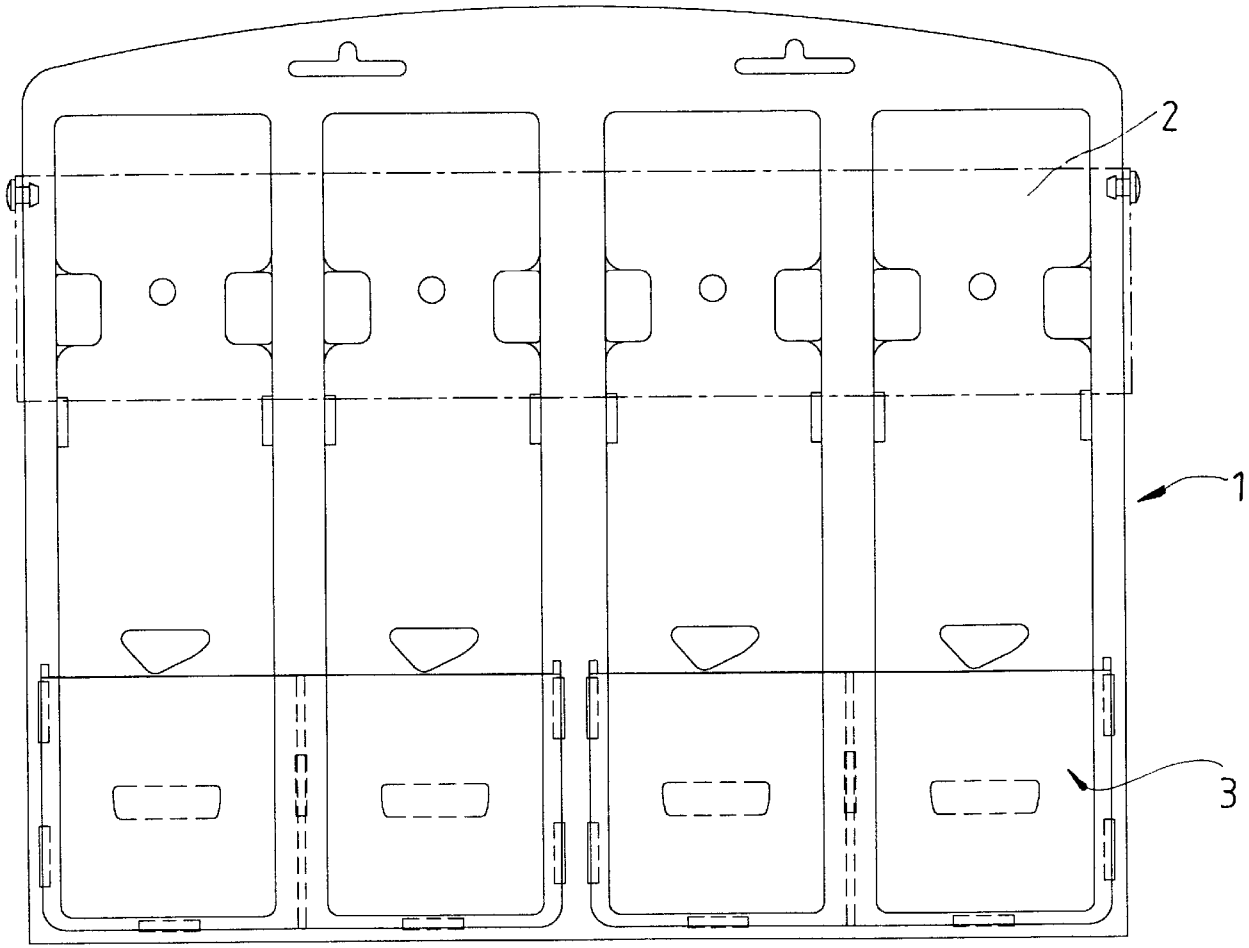
FIG. 5 is an exploded perspective view of the packing box of a second embodiment of the present invention.
Figure 6:
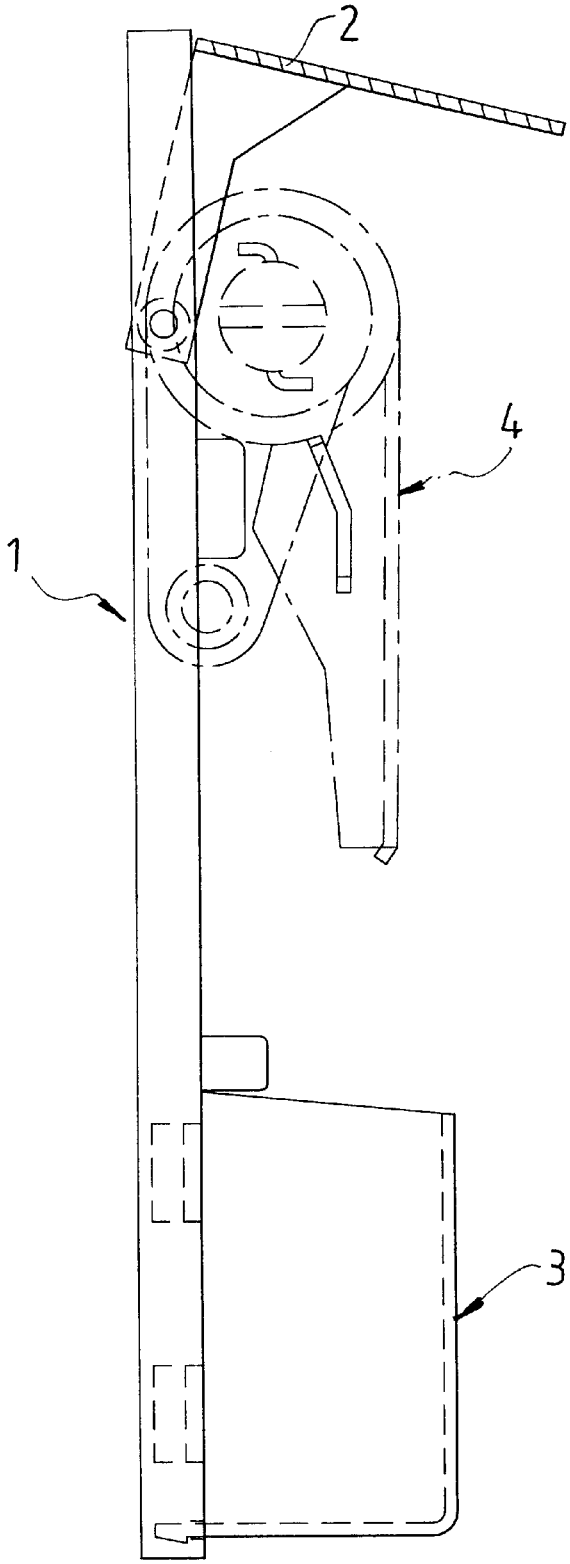
FIG. 6 is a side view of the packing box of the present invention with the upper cover in open position.

Referring to FIG. 5, the packing box can be formed with as many containing rooms as needed by the manufacturers according to a second embodiment of the present invention.

Figure 7:
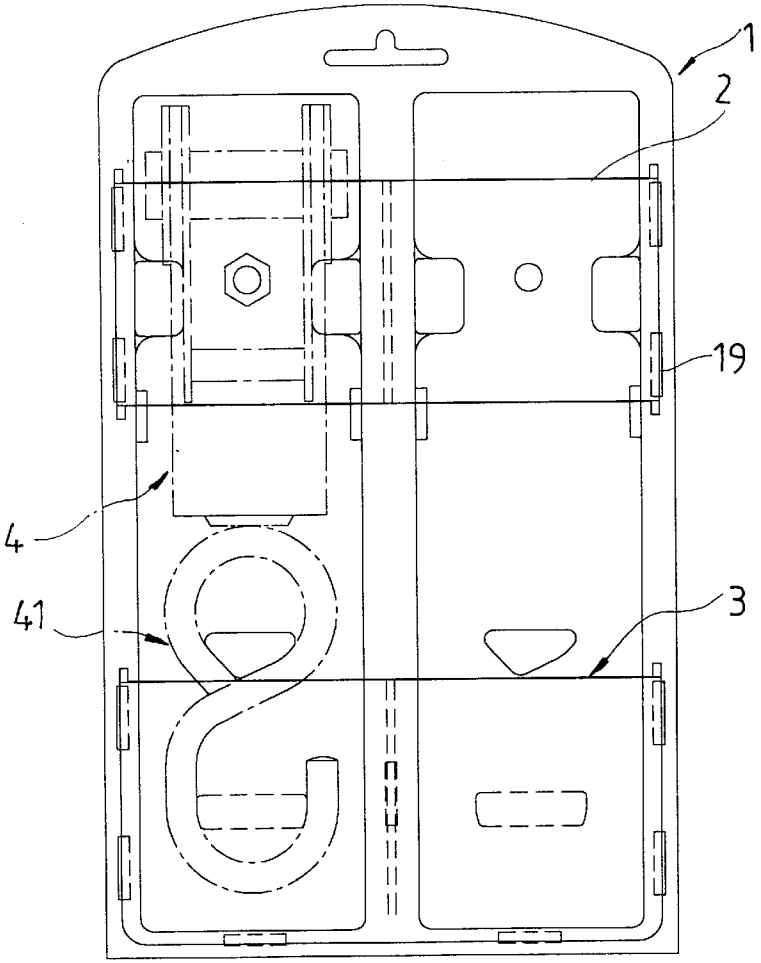
FIG. 7 is a front view of the packing box of a third embodiment of the present invention.
Figure 8:
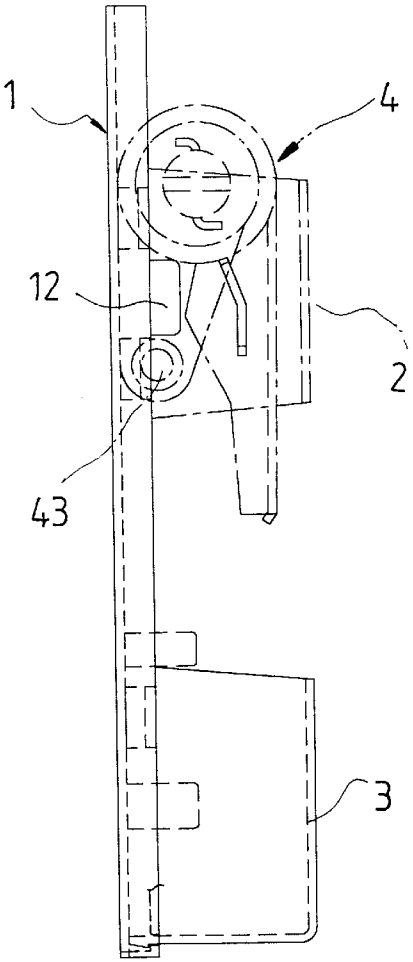
FIG. 8 is a side view of the packing box of the third embodiment of the present invention.

In a third embodiment of the invention, referring to FIGS. 7, and 8, the upper cover 2 of the first embodiment is formed with engaging hooks instead of the through holes 23 on the lateral portions 22 thereof and the upper portions of the outermost lateral walls 18 are formed with connecting holes 19; thus, the upper cover 2 can be detachably joined to the holding plate 1 with the engaging hooks being inserted into the upper through holes 19, similar to the lower cover 3.

From the above description, it can be easily understood that the packing box of the present invention has advantages as followings:

1. The winch can be easily taken out from, and put back into, the packing box without possibility of damage being caused to the same because the upper cover 2 pivots on the holding plate 1 to be easily movable.
2. It is convenient for customers to take out the winch product from the packing box for trial or inspection. Therefore, the customers can know very well about the product, and understand its performance so that they can readily decide whether or not to buy the product.

What is claimed is:

1. A packing box for a lashing rope winch, comprising a holding plate having walls sticking out from one side thereof; the walls defining a plurality of side by side arranged containing rooms;

the holding plate having two opposite securing protrusions adjacent to upper portions of two opposite lateral ones of the walls of each of the containing rooms for allowing tight insertion of a main body of a lashing rope winch into between;

the holding plate having a pair of spaced apart upper and lower securing poles in a lower portion of each of the containing rooms for allowing mounting of a circular portion and a hooked portion of a hook of the winch respectively;

an upper cover, the upper cover being pivoted to an upper portion of the holding plate at two lateral portions thereof to cover an upper section of the containing rooms;

a lower cover, the lower cover being detachably joined to a lower portion of the holding plate at two lateral portions thereof.

2. The packing box for a lashing rope winch as claimed in claim 1, wherein the lower cover has engaging hooks on the lateral portions, and two outermost ones of the lateral walls of the holding plate have holes for allowing separable insertion of the engaging hooks therein.

3. The packing box for a lashing rope winch as claimed in claim 1, wherein the holding plate has a through hole in an upper portion of each of the containing rooms so that a screw can be screwed into both the through hole and a hole on the main body of the lashing rope winch supported in one of the containing room to fix the winch in position.

4. The packing box for a lashing rope winch as claimed in claim 1, wherein the holding plate has pivotal holes on two outermost ones of the lateral walls, and the lateral portions of the upper cover have holes so that pivotal pins are passed through the holes and the pivotal holes for pivotal connection of the upper cover to the holding plate.

5. A packing box for a lashing rope winch, comprising a holding plate having walls sticking out from one side thereof; the walls defining a plurality of side by side arranged containing rooms;

the holding plate having two opposite securing protrusions adjacent to upper portions of two opposite lateral ones of the walls of each of the containing rooms for allowing tight insertion of a main body of a lashing rope winch into between;

the holding plate having a pair of spaced apart upper and lower securing poles in a lower portion of each of the containing rooms for allowing mounting of a circular portion and a hooked portion of a hook of the winch respectively;

an upper cover, the upper cover being detachably joined to an upper portion of the holding plate at two lateral portions thereof; and, a lower cover, the lower cover being detachably joined to a lower portion of the holding plate at two lateral portions thereof.

6. The packing box for a lashing rope winch as claimed in claim 5, wherein the lower and the upper covers have engaging hooks on the lateral portions, and two outermost ones of the lateral walls of the holding plate have corresponding holes for allowing separable insertion of the engaging hooks therein.

* * * * *